US011498725B1

(12) United States Patent
Field et al.

(10) Patent No.: US 11,498,725 B1
(45) Date of Patent: Nov. 15, 2022

(54) FLUOROPOLYMER SEPTUM CAP ASSEMBLY

(71) Applicant: Elemental Scientific, Inc., Omaha, NE (US)

(72) Inventors: Michael P. Field, Papillion, NE (US); Kevin Hahn, Omaha, NE (US); Daniel R. Wiederin, Omaha, NE (US)

(73) Assignee: Elemental Scientific, Inc., Omaha, NE (US)

( * ) Notice: Subject to any disclaimer, the term of this patent is extended or adjusted under 35 U.S.C. 154(b) by 579 days.

(21) Appl. No.: 16/523,341

(22) Filed: Jul. 26, 2019

Related U.S. Application Data

(60) Provisional application No. 62/711,090, filed on Jul. 27, 2018.

(51) Int. Cl.
*B65D 41/20* (2006.01)
*B01L 3/00* (2006.01)

(52) U.S. Cl.
CPC ..... *B65D 41/205* (2013.01); *B01L 3/50853* (2013.01); *B01L 2300/042* (2013.01); *B01L 2300/044* (2013.01)

(58) Field of Classification Search
CPC .... B65D 41/045; B65D 41/205; B65D 41/20; B65D 41/28; B65D 51/1616; B65D 51/24; B65D 39/02; B01L 3/50825; B01L 3/50853
USPC ..... 215/247, 261, 350, 349, 341, 364, 363, 215/355, 228; 220/212, 804, 806, 801, 220/796
See application file for complete search history.

(56) References Cited

U.S. PATENT DOCUMENTS

| | | | | |
|---|---|---|---|---|
| 2,438,671 A * | 3/1948 | Marana | B65D 41/12 215/349 |
| 4,682,704 A * | 7/1987 | Kessler | B65D 41/045 215/349 |
| 5,176,271 A * | 1/1993 | Painchaud | B65D 51/20 215/261 |
| 5,992,660 A * | 11/1999 | Miura | B65D 51/002 215/307 |
| 6,382,441 B1 * | 5/2002 | Carano | B65D 41/28 215/349 |
| 7,066,337 B2 * | 6/2006 | Hsu | B01D 46/0002 215/261 |
| 2001/0019021 A1 * | 9/2001 | Riviello, Jr. | B65D 51/24 206/0.5 |
| 2002/0079283 A1 * | 6/2002 | Zurcher | B65D 41/28 215/247 |

FOREIGN PATENT DOCUMENTS

| | | | |
|---|---|---|---|
| EP | 754630 A1 * | 1/1997 | B65D 51/1616 |
| KR | 20180088257 A * | 8/2018 | A45D 34/00 |

OTHER PUBLICATIONS

Translation of EP754630. Wiemer et al. Jan. 22, 1997, Paragraphs 26 and 55 (Year: 1997).*

* cited by examiner

*Primary Examiner* — Robert J Hicks
(74) *Attorney, Agent, or Firm* — Kevin E. West; Advent, LLP

(57) ABSTRACT

A cap assembly includes a base cap, a chemical resistant sheet, and a closure assembly. The closure assembly is configured for carrying the chemical resistant sheet. The closure assembly is mounted in the base cap. The base cap and the closure assembly together define a central cap assembly aperture therethrough.

18 Claims, 4 Drawing Sheets

FLUOROPOLYMER SEPTUM CAP ASSEMBLY

RELATED APPLICATIONS

This application claims domestic priority to U.S. Provisional Application Ser. No. 62/711,090, filed Jul. 27, 2018, entitled "FLUOROPOLYMER SEPTUM CAP ASSEMBLY." The contents of U.S. 62/711,090 are hereby incorporated by reference thereto.

BACKGROUND

Liquid samples can be placed in sample vials or containers for access by an autosampler probe to introduce the samples to a sample preparation system or analysis system. Multiple sample vials or containers can be made available to the autosampler probe, such as through a sample rack holding multiple vials or containers. Sample introduction systems may be employed, for example, to introduce the liquid samples into ICP spectrometry instrumentation (e.g., an Inductively Coupled Plasma Mass Spectrometer (ICP/ICP-MS), an Inductively Coupled Plasma Atomic Emission Spectrometer (ICP-AES), or the like) for analysis. For example, a sample introduction system may withdraw an aliquot of a liquid sample from a container and thereafter transport the aliquot to a nebulizer that converts the aliquot into a polydisperse aerosol suitable for ionization in plasma by the ICP spectrometry instrumentation.

SUMMARY

This Summary is provided to introduce a selection of concepts in a simplified form that are further described below in the Detailed Description. This Summary is not intended to identify key and/or essential features of the claimed subject matter. Also, this Summary is not intended to limit the scope of the claimed subject matter in any manner.

Aspects of the disclosure relate to a cap assembly. A cap assembly can include a base cap, a chemical resistant sheet, and a closure assembly. The closure assembly can be configured for carrying the chemical resistant sheet. The closure assembly can be mounted in the base cap. The base cap and the closure assembly together can define a central cap assembly aperture therethrough.

DRAWINGS

The Detailed Description is described with reference to the accompanying figures.

DETAILED DESCRIPTION

Overview

Exposed sample vials or containers can pose risks to the integrity of the sample or the surrounding environment or may pose a threat to individuals in the vicinity of the sample. For example, volatile samples can have portions of the sample leave the sample container, potentially hazardous and/or noxious samples can be exposed to individuals such as during removal of container caps to permit access to the sample by the probe, the samples can degas while waiting to be sampled, and/or the samples can be exposed to dust or other environmental contaminants.

Caps or lids can cover and seal a sample container. However, such covers can require their removal before the sample is exposed to the autosampler probe. Septum caps can be used to provide a material barrier between the sample and the environment, where the material barrier is configured to be pierced by the sample probe. Yet, such caps typically are single-use disposable caps for small sample volumes and may be unsuitable for many corrosive samples, such as concentrated acids.

According to an example implantation of the disclosure, a reusable cap can be designed to fit onto a sample container, where the cap supports a chemical resistant sheet (e.g., a chemical resistant septum). In an embodiment, the supported chemical resistant sheet is a single-use component. In some embodiments, the chemical resistant sheet is made, at least in part, of a fluoropolymer, and, in a particular implementation, is a perfluoroalkoxy alkane (PFA) sheet. In some embodiments, the cap is designed to fit onto larger sample containers, for example 250 mL sample bottles. The sheet can be supported by two closure plates: a lower plate that fits over an opening/mouth of the sample container, and an upper plate that seals the sheet between the upper plate and the lower plate. Overall, the cap assembly, including the base cap, the closure assembly, and the chemical resistant sheet, can act to provide a seal and a barrier between the sample held in the container and the external environment yet facilitate access to the sample, through the chemical resistant sheet using, for example, an autosampler probe.

The closure plates can each define an aperture in the middle, with the chemical resistant sheet being held taut across the aperture to provide a septum that can be pierced by an autosampler probe. In an embodiment, the closure plates are made of a reusable, chemically resistant material. In some implementations, the closure plates are formed from polytetrafluoroethylene (PTFE) materials to provide reusable structures (e.g., following a washing procedure) to hold the disposable PFA sheets. The PTFE/PFA materials are resistant to strong acids and other corrosive chemicals to provide a reusable base structure and a disposable sheet.

Example Implementations

Figure 1:
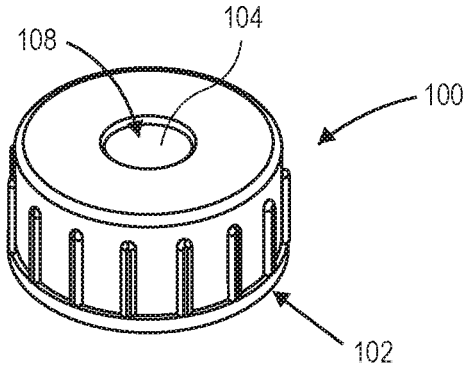
FIG. 1 is a front, isometric view of a fluoropolymer septum cap assembly, in accordance with an example embodiment of the present disclosure.
Figures 2A, 2B:
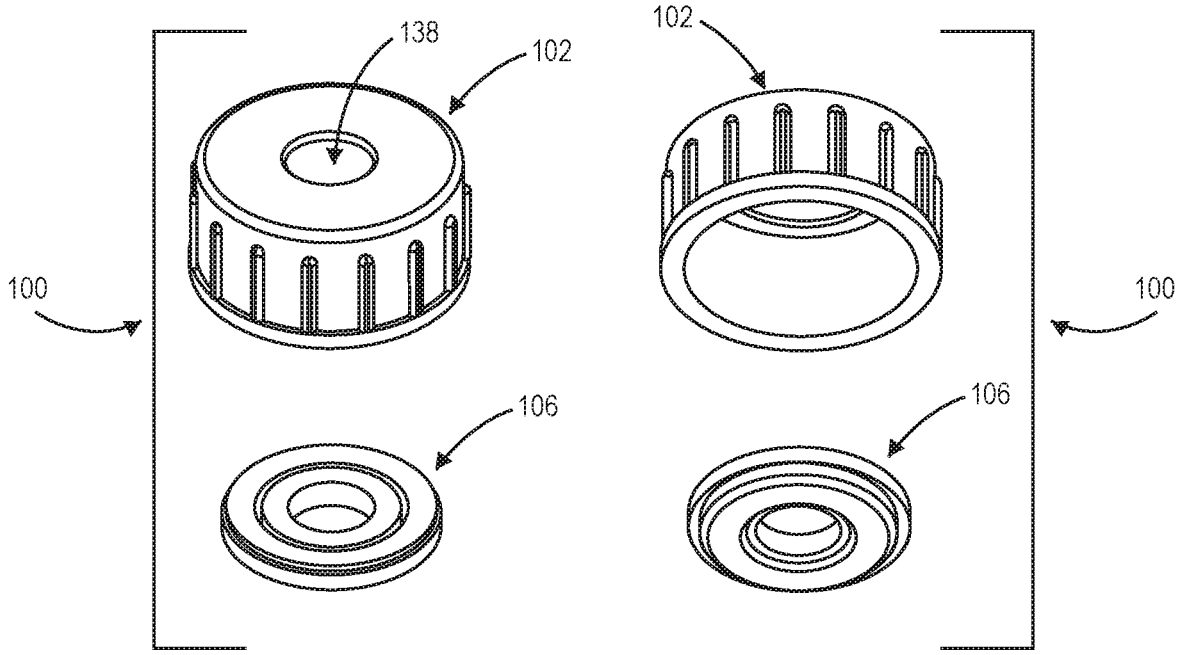
FIGS. 2A and 2B are partially exploded views of the fluoropolymer septum cap assembly shown in FIG. 1.
Figure 3:
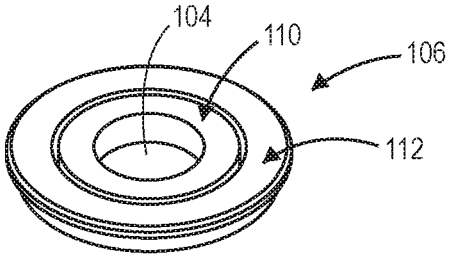
FIG. 3 is top, front, isometric view of a closure assembly carrying a chemical resistant sheet or septum, in accordance with an example embodiment of the present disclosure.
Figure 4:
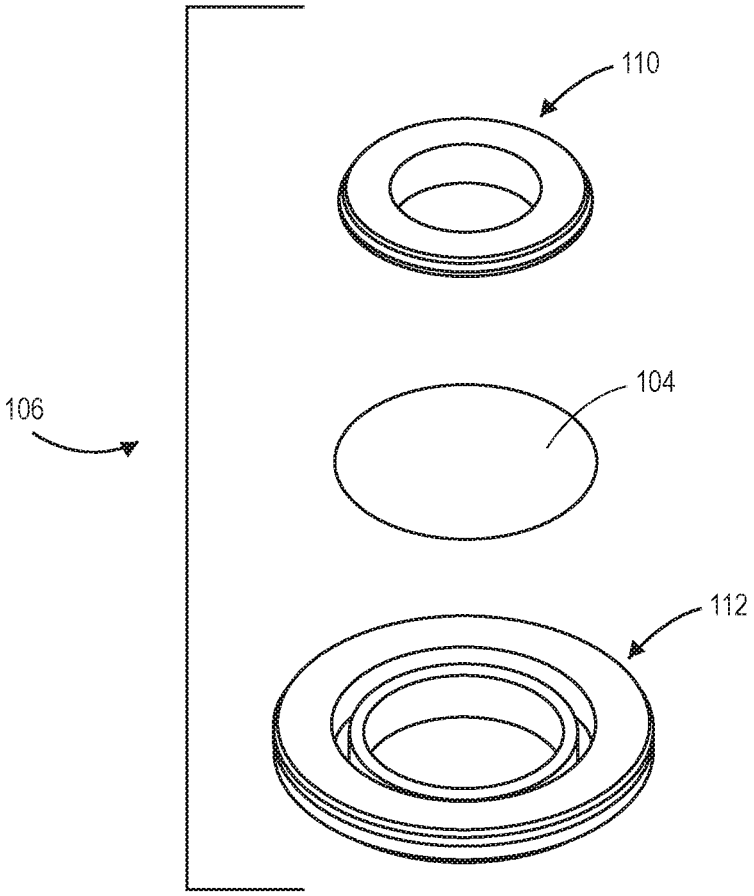
FIG. 4 is a top, front, exploded view of the closure assembly shown in FIG. 3.
Figure 5A:
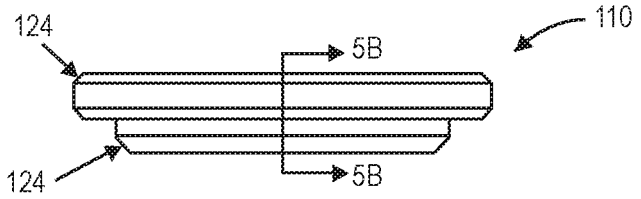
FIG. 5A is side view of an upper closure plate for use in the closure assembly shown in FIG. 4.
Figure 5B:
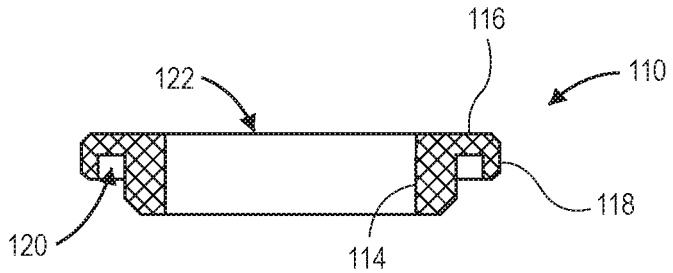
FIG. 5B is a cross-sectional view of the upper closure plate, taken along line 5B-5B in FIG. 5A.
Figure 6A:
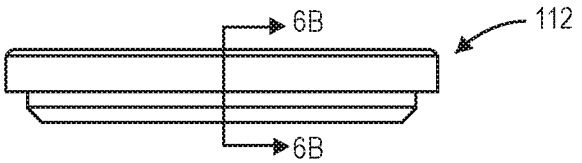
FIG. 6A is a side view of a lower closure plate for use in the closure assembly shown in FIG. 4.
Figure 6B:
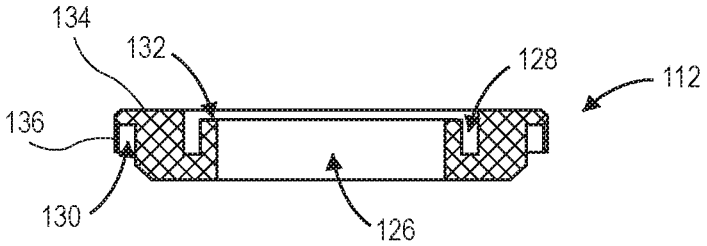
FIG. 6B is a cross-sectional view of the lower closure plate, taken along line 6B-6B in FIG. 5A.

FIGS. 1, 2A, and 2B generally illustrate a fluoropolymer septum cap assembly 100 according to an example embodiment of the present disclosure. The cap assembly 100 can include a base cap or lid 102, a chemical resistant sheet or septum 104, and a closure assembly 106 configured for carrying the chemical resistant sheet 104. The cap assembly 100 can be configured for releasable attachment to a sample container (not shown), such as a sample bottle (e.g., via screw-threading (not shown) in the interior of the base cap 102 or via a snap-fit of the base cap 102). The base cap 102 can be sized and configured to retain the closure assembly 106 therein. In some embodiments, the closure assembly 106 and base cap 102 may form a transition fit (e.g., tight, similar, or fixed) therebetween, so that such parts are readily assembled or disassembled, yet provide a sufficient seal therebetween (e.g., to help retain any material, including liquid and/or vapors, held by the container).

The base cap 102 and the closure assembly 106 together can be considered to be a carrier assembly configured to carry the chemical resistant sheet 104 and to expose a portion of that sheet 104, e.g., for access by an autosampler probe (not shown), through a cap assembly aperture 108, centrally defined in the cap assembly 100. That is, a portion of the chemical resistant sheet 104 lies within the cap assembly aperture 108. In an embodiment, the base cap or lid 102 and the closure assembly 106 can be made of a chemically resistant, reusable material (e.g., PTFE). In an embodiment, the material(s) used for those two components can be resistant to strong acids and other corrosive chemicals. In an embodiment, the base cap 102 and the closure assembly 106 are the reusable elements of the cap assembly 100.

As shown best in FIGS. 3-6B, the closure assembly 106 can include an upper closure plate 110 and a lower closure plate 112, between which the chemical resistant sheet 104 can be mounted or carried. The upper closure plate 110 can define an inner ring 114, an outer circumferential ledge 116, and an outer ring 118. The inner ring 114, the outer circumferential ledge 116, and the outer ring 118 together define an upper-plate retention groove 120. The upper-plate retention groove 120 can be concentric with the inner ring 114 and the outer ring 118 and can face (i.e., open toward) the bottom of the upper closure plate 110. The inner ring 114, the outer circumferential ledge 116, and the outer ring 118 can be co-formed (e.g., molded as a single unit) or attached to one another. The inner ring 114 can further define an inner ring aperture 122, which can partly define the overall cap assembly aperture 108. The outer circumferential ledge 116 may extend from an upper side of the inner ring 114, and the outer ring 118 may be less in height than the inner ring 114 (e.g., about half the height), which may facilitate assembly of the upper closure plate 110 with the lower closure plate 112. The upper closure plate 110 may be provided with one or more upper plate chamfers 124 (e.g., at outward facing surfaces) to aid mating with the lower closure plate 112.

The lower closure plate 112 can define, starting at the center thereof and moving radially outwardly, a lower-plate aperture 126, an upward-facing interior groove 128, and a downward-facing exterior groove 130. The lower closure plate 112 can further define a central offset region 132. The central offset region 132 can extend inwardly from a top plate face 134 of the lower closure plate 112 and across and above the lower-plate aperture 126 and the upward-facing interior groove 128. The central offset region 132 can be sized (e.g., diameter and/or depth) and configured to accommodate and receive the chemical resistant sheet 104. In an embodiment, the chemical resistant sheet 104 is greater in diameter than the lower-plate aperture 126 (e.g., so as to not fall therethrough).

The lower-plate aperture 126, the upward-facing interior groove 128, and the central offset region 132 together can be configured to receive and retain the upper closure plate 110 therein, with the chemical resistant sheet 104 positioned and held therebetween. Particularly, the inner ring 114 of the upper closure plate 110 may be received in the lower-plate aperture 126; and the outer ring 118 of the upper closure plate 110 may in received by upward-facing interior groove 128. If large enough, a portion of the chemical resistant sheet 104 may be displaced into the upward-facing interior groove 128 upon assembly of the components, thus aiding in retention of the chemical resistant sheet 104. When the chemical resistant sheet 104 is pressed and effectively clamped between the closure plates 110, 112, the chemical resistant sheet 104 can become taut to provide a structure against which the autosampler probe (not shown) can press and, ultimately, penetrate.

In some embodiments, the upper closure plate 110, the lower closure plate 112, and the chemical resistant sheet 104 may fit together to form a constant-thickness or near constant-thickness closure assembly 106, which may promote a better fit and/or seal with the base cap 102. The downward-facing exterior groove 130 may promote the flexibility of the lower closure plate 112 and, thus, may facilitate the assembly of the upper closure plate 110 with the lower closure plate 112. The lower closure plate 112 may, for example, be integrally formed (e.g., via molding). The lower closure plate 112 may further define an outer flange 136 radially exterior of the downward-facing exterior groove 130. When provided, the outer flange 136 extends downwardly and defines the outer diameter of the lower closure plate 112. That outer diameter can correspond to the inner diameter of the sample container opening (not shown) to seal the sample container when the closure assembly 106 is positioned over the sample container opening. The closure plates 110, 112, along with the base cap 102, can be positioned over the opening of the sample container (not shown), where the outer flange 136 of the lower closure plate 112 may be configured to rest on top of the lip of the sample container opening, e.g., to create a seal between the interior of the base cap 102 and the lip of the bottle. The septum cap assembly 100 can provide a tight seal to protect the sample (not shown) from the external environment until the autosampler probe pierces the chemical resistant sheet 104, allowing the assembly 100 to be used with, for example, volatile samples, hazardous samples, and/or other samples, while avoiding risk of exposure to environmental contaminants.

A base cap 102 can be placed over and receive the closure plate/sheet assembly 106, 104. The base cap 102 defines a cap aperture 138 that corresponds to the inner ring aperture 122 (i.e., the upper-plate aperture) of the upper closure plate 110 and to the lower-plate aperture 126 of the lower closure plate 112, such apertures 122, 126, 138 together defining the cap assembly aperture 108. In some embodiments, the base cap 102 can include an internal threading (not shown) configured to mate with exterior threading on the sample container (not shown) to friction fit the septum cap assembly 100 against the sample container, preventing leakage of sample from the sample container. The closure plates 110, 112 and the base cap 102 can be reused, such as following a washing/rinse procedure, where the chemical resistant sheet 104 is disposable. A new chemical resistant sheet 104 can be incorporated for additional use of the assembly 100.

The chemical resistant sheets 104 may be susceptible to static electricity, which can become problematic during positioning of a given chemical resistant sheet 104 between the two closure plates 110, 112. A loading station (not shown) can be used to assist with positioning of the sheet 104 between the two closure plates 110, 112. The loading station can include a container having an opening dimensioned similarly to the opening of the sample container onto which the assembly is introduced. A vacuum can be applied to the interior of the container of the loading station. An individual or a loading arm can place the lower closure plate 112 over the opening, and then move the chemical resistant sheet 104 over the opening. The vacuum can then pull the chemical resistant sheet 104 against the lower closure plate 112, while the individual or loading arm can press the upper closure plate 110 into the lower closure plate 112, securing the chemical resistant sheet 104 therebetween.

Figure 7A:
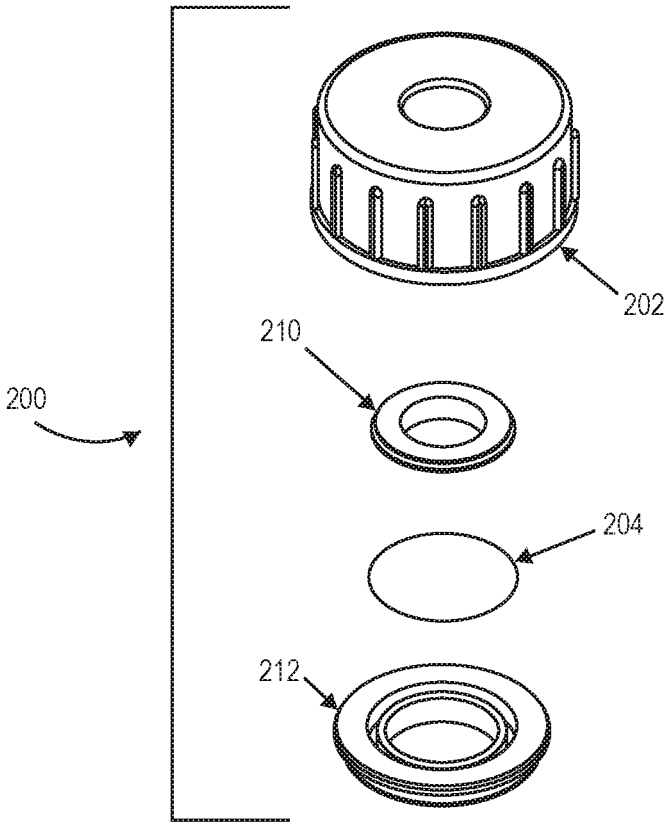
FIGS. 7A and 7B are front, exploded views of another fluoropolymer septum cap assembly, in accordance with an example embodiment of the present disclosure.
Figure 7B:
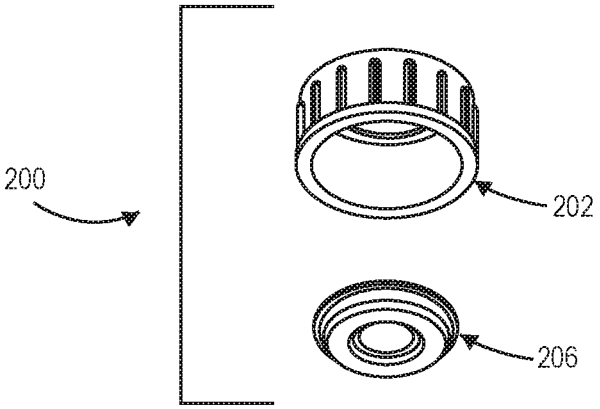

FIGS. 7A and 7B generally illustrate a fluoropolymer septum cap assembly 200 according to another example embodiment of the present disclosure. The cap assembly 200 can include a base cap or lid 202, a chemical resistant sheet or septum 204, and a closure assembly 206 configured for carrying the chemical resistant sheet 204. The closure assembly 206 can include an upper closure plate 210 and a lower closure plate 212, between which the chemical resistant sheet 204 can be mounted or carried. The use of the similar reference numbers in the description and the figures for the cap assembly 100 and the cap assembly 200 may indicate similar or identical items, unless otherwise expressly noted. The cap assembly 200 can differ from the cap assembly 100 in that the lower closure plate 212 does not include an outer flange 136, nor does the lower closure plate 212 define a downward-facing exterior groove (e.g., groove 130 of the lower closure plate 112).

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A cap assembly, comprising:

a base cap configured for releasable attachment to a container;

a chemical resistant sheet; and a closure assembly including an upper closure plate and lower closure plate, the upper closure plate mounted to the lower closure plate, the upper closure plate and the lower closure plate carrying the chemical resistant sheet therebetween, the closure assembly mounted in the base cap, the base cap and the closure assembly together defining a central cap assembly aperture, a portion of the chemical resistant sheet lying within the cap assembly aperture.

2. The cap assembly of claim 1, wherein the chemical resistant sheet is comprised of a fluoropolymer material.

3. The cap assembly of claim 2, wherein the chemical resistant sheet is comprised of a perfluoroalkoxy alkane material.

4. The cap assembly of claim 1, wherein the chemical resistant sheet is configured to be pierced by an autosampler probe.

5. The cap assembly of claim 1, wherein the base cap and the closure assembly are chemically resistant, reusable components.

6. The cap assembly of claim 1, wherein the upper closure plate defines an inner ring, an outer circumferential ledge, and an outer ring, the inner ring, the outer circumferential ledge, and the outer ring together defining an upper-plate retention groove.

7. The cap assembly of claim 1, wherein the lower closure plate defines, starting at the center thereof and moving radially outwardly, a lower-plate aperture, an upward-facing interior groove, and a downward-facing exterior groove.

8. The cap assembly of claim 7, wherein the lower closure plate further defines a central offset region, the central offset region extending inwardly from a top plate face of the lower closure plate and across and above the lower-plate aperture and the upward-facing interior groove, the central offset region configured to accommodate and receive the chemical resistant sheet.

9. The cap assembly of claim 8, wherein the lower-plate aperture, the upward-facing interior groove, and the central offset region together configured to receive and retain the upper closure plate therein, with the chemical resistant sheet positioned and held therebetween.

10. A closure assembly, comprising:

an upper closure plate; and a lower closure plate, the lower closure plate including a central offset region configured to receive a chemical resistant sheet between the upper closure plate and the lower closure plate when the upper closure plate is received into the lower closure plate.

11. The closure assembly of claim 10, wherein the upper closure plate and the lower closure plate are chemically resistant, reusable components.

12. The closure assembly of claim 10, wherein the closure assembly includes an upper closure plate and lower closure plate, the upper closure plate mounted to the lower closure plate, the upper closure plate and the lower closure plate configured for carrying the chemical resistant sheet therebetween.

13. The closure assembly of claim 12, wherein the upper closure plate defines an inner ring, an outer circumferential ledge, and an outer ring, the inner ring, the outer circumferential ledge, and the outer ring together defining an upper-plate retention groove.

14. The closure assembly of claim 12, wherein the lower closure plate defines, starting at the center thereof and moving radially outwardly, a lower-plate aperture, an upward-facing interior groove, and a downward-facing exterior groove.

15. The closure assembly of claim 14, wherein the lower closure plate further defines a central offset region, the central offset region extending inwardly from a top plate face of the lower closure plate and across and above the lower-plate aperture and the upward-facing interior groove, the central offset region configured to accommodate and receive the chemical resistant sheet.

16. The closure assembly of claim 15, wherein the lower-plate aperture, the upward-facing interior groove, and the central offset region together receive and retain the upper closure plate therein.

17. An assembly, comprising:

a base cap configured for releasable attachment to a container; and a closure assembly including an upper closure plate and lower closure plate, the upper closure plate mounted to the lower closure plate, the upper closure plate and the lower closure plate configured to carry the chemical resistant sheet therebetween, the closure assembly mounted in the base cap, the base cap and the closure assembly together defining a central cap assembly aperture, a portion of the chemical resistant sheet configured to lie within the cap assembly aperture.

18. The assembly of claim 17, wherein the base cap and the closure assembly are chemically resistant, reusable components.

* * * * *